US011534813B2

(12) United States Patent
Asano et al.

(10) Patent No.: US 11,534,813 B2
(45) Date of Patent: Dec. 27, 2022

(54) METHOD FOR MANUFACTURING PIPE

(71) Applicant: TOYOTA JIDOSHA KABUSHIKI KAISHA, Toyota (JP)

(72) Inventors: Masahiko Asano, Toyota (JP); Yoshihiko Ukai, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/140,201

(22) Filed: Jan. 4, 2021

(65) Prior Publication Data

US 2021/0245221 A1 Aug. 12, 2021

(30) Foreign Application Priority Data

Feb. 12, 2020 (JP) ..... JP2020-021787

(51) Int. Cl.

| | |
|---|---|
| ***B21D 5/01*** | (2006.01) |
| ***B21C 37/15*** | (2006.01) |
| ***B21D 22/28*** | (2006.01) |
| ***B21D 51/10*** | (2006.01) |

(52) U.S. Cl.

CPC ..... *B21D 5/015* (2013.01); *B21C 37/156* (2013.01); *B21D 22/28* (2013.01); *B21D 51/10* (2013.01)

(58) Field of Classification Search

CPC ..... B21C 37/065; B21C 37/104; B21C 37/15; B21C 37/156; B21C 37/155; B21C 37/16; B21C 37/185; B21C 37/08; B21D 5/015; B21D 5/10; B21D 51/10

See application file for complete search history.

(56) References Cited

U.S. PATENT DOCUMENTS

| | | | | |
|---|---|---|---|---|
| 4,971,239 | A * | 11/1990 | Tyler | B21C 37/185 228/146 |
| 2001/0013242 | A1* | 8/2001 | Kondou | B21C 37/104 72/379.2 |
| 2017/0274434 | A1 | 9/2017 | Sato et al. | |

FOREIGN PATENT DOCUMENTS

| | | | |
|---|---|---|---|
| DE | 103 29 424 | A1 | 1/2005 |
| JP | 2001-286934 | A | 10/2001 |
| JP | 2003-225724 | A | 8/2003 |
| JP | 2017-192978 | A | 10/2017 |
| JP | 2018-167283 | A | 11/2018 |
| JP | 2019-022912 | A | 2/2019 |

* cited by examiner

*Primary Examiner* — Debra M Sullivan

(74) *Attorney, Agent, or Firm* — Oblon, McClelland, Maier & Neustadt, L.L.P.

(57) ABSTRACT

A method for manufacturing a pipe includes: press-forming a plate member into a U shape; and press-forming the plate member formed into the U shape into an O shape. The pipe includes a pipe body and a tapered part tilted radially inward and protruding from one end of the pipe body. Before the plate member is press-formed into the U shape, a boundary between a portion of the plate member corresponding to the pipe body and a portion of the plate member corresponding to the tapered part is pressed from a surface of the plate member corresponding to an inner peripheral surface of the pipe to bend the portion of the plate member corresponding to the tapered part toward the surface of the plate member corresponding to the inner peripheral surface of the pipe.

8 Claims, 5 Drawing Sheets

METHOD FOR MANUFACTURING PIPE

CROSS-REFERENCE TO RELATED APPLICATION

This application claims priority to Japanese Patent Application No. 2020-021787 filed on Feb. 12, 2020, incorporated herein by reference in its entirety.

BACKGROUND

1. Technical Field

The disclosure relates to method for manufacturing a pipe.

2. Description of Related Art

As disclosed in, e.g., Japanese Unexamined Patent Application Publication No. 2019-022912 (JP 2019-022912 A), UO forming is widely used as a method for manufacturing a pipe. UO forming is a press forming process in which a plate member is press-formed into a U shape (U forming) and then press-formed into an O shape (cylindrical shape) (O forming) by using a pair of dies each having a cavity with a semicircular section.

SUMMARY

The inventors examined use of UO forming to manufacture a pipe including a tapered part protruding from one end of a pipe body in such a manner that the tapered part is tilted radially inward from the one end of the pipe body, and found the following problem. For example, in the case where such a pipe is manufactured by merely using UO forming, the tapered part of the pipe protrudes along an extension of the longitudinal direction of the pipe body. When the tapered part is bent and tilted radially inward after UO forming, wrinkling or cracking may occur near the boundary between the pipe body and the tapered part.

The disclosure provides a method for manufacturing a pipe which reduces wrinkling and cracking near the boundary between a pipe body and a tapered part.

A method for manufacturing a pipe according to an aspect of the disclosure includes: press-forming a plate member into a U shape; and press-forming the plate member formed into the U shape into an O shape. The pipe includes a pipe body and a tapered part tilted radially inward and protruding from one end of the pipe body. Before the plate member is press-formed into the U shape, a boundary between a portion of the plate member corresponding to the pipe body and a portion of the plate member corresponding to the tapered part is pressed from a surface of the plate member corresponding to an inner peripheral surface of the pipe to bend the portion of the plate member corresponding to the tapered part toward the surface of the plate member corresponding to the inner peripheral surface of the pipe.

According to the above aspect, before the plate member is press-formed into the U shape, the boundary between the portion of the plate member corresponding to the pipe body and the portion of the plate member corresponding to the tapered part is pressed from the surface of the plate member corresponding to the inner peripheral surface of the pipe to bend the portion of the plate member corresponding to the tapered part toward the surface of the plate member corresponding to the inner peripheral surface of the pipe. This reduces wrinkling and cracking at the boundary between the portion corresponding to the pipe body and the portion corresponding to the tapered part as compared to the case where the portion corresponding to the tapered part is bent after U forming or O forming.

In the above aspect, a bend having a groove shape may be formed at the boundary when the boundary is pressed. According to the above configuration, since the portion where the bend has been formed is work-hardened by compression, a taper angle of the portion corresponding to the tapered part is maintained even during U forming and O forming that will be performed later, and springback is also reduced.

In the above aspect, the bend may have a curved section. With this configuration, the plate member is less likely to become excessively thin at the bend.

In the above aspect, when the boundary is pressed, the bend may be formed while bending a middle part of the portion corresponding to the pipe body into a U shape. The above configuration further reduces wrinkling and cracking at the boundary between the portion corresponding to the pipe body and the portion corresponding to the tapered part.

In the above aspect, the bend may be formed by pressing the boundary with a punch having a ridge corresponding to the bend. According to the above configuration, the bend is easily formed.

In the above aspect, a die on which the plate member is placed when the boundary is pressed may be provided with a groove at a position corresponding to the ridge of the punch.

In the above aspect, a die on which the plate member is placed when the boundary is pressed may be a die divided by a clearance that is predetermined. The clearance may be located at a position corresponding to the ridge of the punch. According to the above configuration, the plate member is less likely to become excessively thin at the bend, and the life of the ridge of the punch is increased.

In the above aspect, the ridge of the punch may have a curved section.

In the above aspect, a radius of curvature of the portion corresponding to the pipe body after the plate member is press-formed into the U shape may be smaller than a radius of curvature of the portion corresponding to the pipe body after the plate member formed into the U shape is press-formed into the O shape.

According to the above aspect of the disclosure, a method for manufacturing a pipe is provided which reduces wrinkling and cracking near the boundary between a pipe body and a tapered part.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

A specific embodiment to which the disclosure is applied will be described in detail with reference to the accompanying drawings. The disclosure is not limited to the following embodiment. For clarity of explanation, the following description and drawings are simplified as appropriate.

Pipe Configuration

Figure 1:
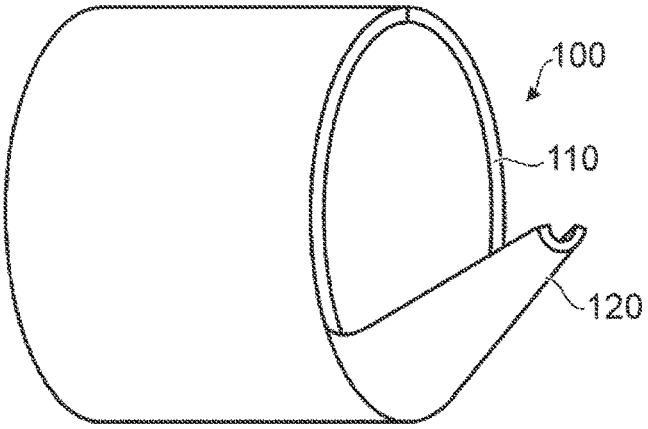
FIG. 1 is a perspective view of a pipe manufactured using a method for manufacturing a pipe according to an embodiment of the disclosure.

Before describing a method for manufacturing a pipe according to an embodiment of the disclosure, a pipe that is manufactured by this method will be described with reference to FIG. 1. FIG. 1 is a perspective view of a pipe manufactured by the method for manufacturing a pipe according to the embodiment of the disclosure. As shown in FIG. 1, a pipe 100 includes a pipe body 110 and a tapered part 120. Use of the pipe 100 is not limited.

As will be described in detail later, the pipe 100 is formed by UO forming of a single plate member made of, e.g., a metal etc., and abutting portions of the pipe body 110 are welded together. As shown in FIG. 1, the tapered part 120 protrudes from one end of the pipe body 110 in such a manner that the tapered part 120 is tilted radially inward from the one end of the pipe body 110. The tapered part 120 is located at the one end of the pipe body 110 along a part of the circumference (e.g., about ¼ to ⅓ of the entire circumference) rather than along the entire circumference of the pipe body 110. In the example of FIG. 1, the tapered part 120 has a trapezoidal shape that narrows as it gets closer to its tip end. However, the shape of the tapered part 120 is not particularly limited.

Method for Manufacturing a Pipe

Figure 2A:
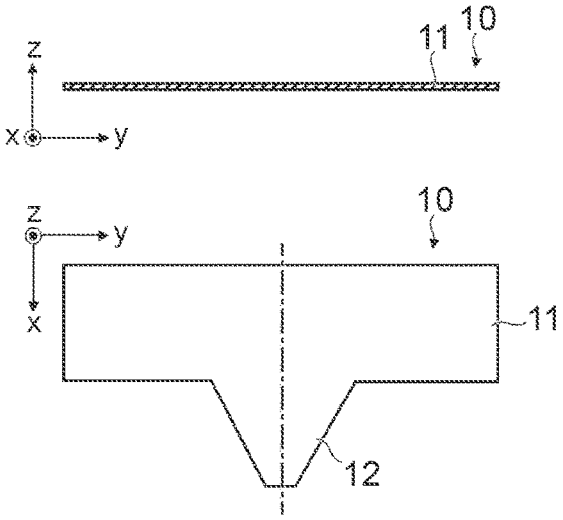
FIG. 2A shows sectional and plan views of a plate member before edge bending.
Figure 2B:
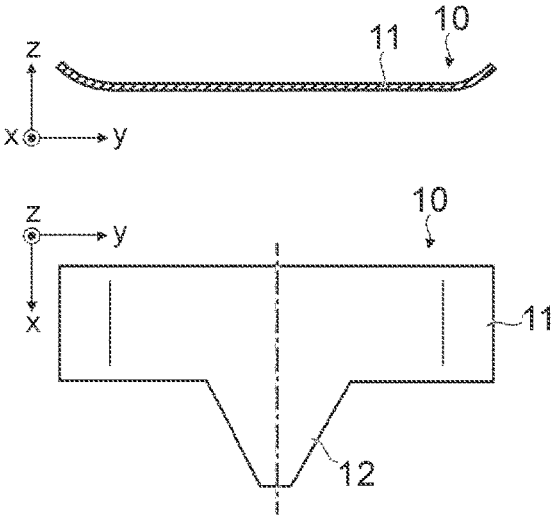
FIG. 2B shows sectional and plan views of the plate member after edge bending.

The method for manufacturing a pipe according to the embodiment of the disclosure will be described with reference to FIGS. 2A to 9B. First, an edge bending process will be described with reference to FIGS. 2A and 2B. FIGS. 2A and 2B illustrate the edge bending process. FIG. 2A shows sectional and plan views of a plate member 10 before edge bending. FIG. 2B shows sectional and plan views of the plate member 10 after edge bending. Although the plate member 10 is not particularly limited, the following description illustrates the case where the plate member 10 is a metal plate.

It should be understood that the right-handed xyz Cartesian coordinate system shown in FIGS. 2A to 9B is shown for convenience in order to illustrate the positional relationship between or among components. Usually, the positive z-axis direction is upward in the vertical direction, and the xy plane is a horizontal plane. The same applies to all the figures.

As shown in the sectional view of FIG. 2A, the plate member 10 before edge bending is flat. As shown in the plan view of FIG. 2A, the plate member 10 is composed of a portion 11 corresponding to the pipe body 110 shown in FIG. 1 and having a rectangular shape as viewed in plan, and a portion 12 corresponding to the tapered part 120 shown in FIG. 1 and having a trapezoidal shape as viewed in plan. Hereinafter, the portion 11 corresponding to the pipe body 110 is referred to as the "pipe body portion 11," and the portion 12 corresponding to the tapered part 120 is referred to as the "taper portion 12." In other words, the pipe body portion 11 is a portion to be formed into the pipe body 110 shown in FIG. 1, and the taper portion 12 is a portion to be formed into the tapered part 120 shown in FIG. 1. The longitudinal direction (y-axis direction) of the pipe body portion 11 corresponds to the circumferential direction of the pipe 100 of FIG. 1 to be manufactured. The lateral direction (x-axis direction) of the pipe body portion 11 corresponds to the longitudinal direction of the pipe 100 of FIG. 1 to be manufactured.

The taper portion 12 protrudes from the middle part in the longitudinal direction (y-axis direction) of the pipe body portion 11 along an extension of the lateral direction (positive x-axis direction) of the pipe body portion 11. The taper portion 12 has an isosceles trapezoidal shape, and the width (length in the y-axis direction) of the taper portion 12 decreases as it gets farther away from the pipe body portion 11. The flat plate member 10 shown in FIG. 2A is produced by, e.g., blanking.

As shown in FIG. 2B, in the edge bending process, both ends in the longitudinal direction (y-axis direction) of the pipe body portion 11 are bent to the upper surface side of the pipe body portion 11 (in the positive z-axis direction) by press forming etc. The upper surface of the pipe body portion 11 corresponds to the inner peripheral surface of the pipe 100 of FIG. 1 to be manufactured. The lower surface of the pipe body portion 11 corresponds to the outer peripheral surface of the pipe 100 of FIG. 1 to be manufactured.

Figure 3A:
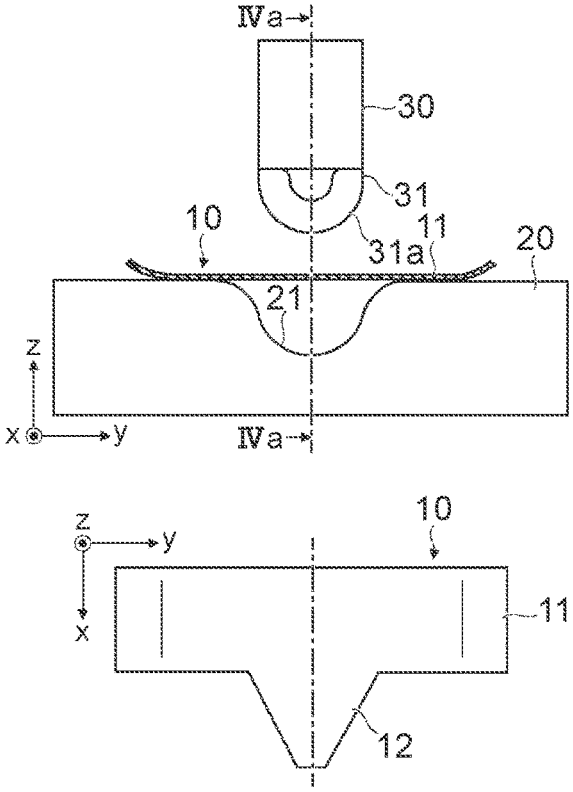
FIG. 3A shows sectional and plan views of the plate member before bending.
Figure 3B:
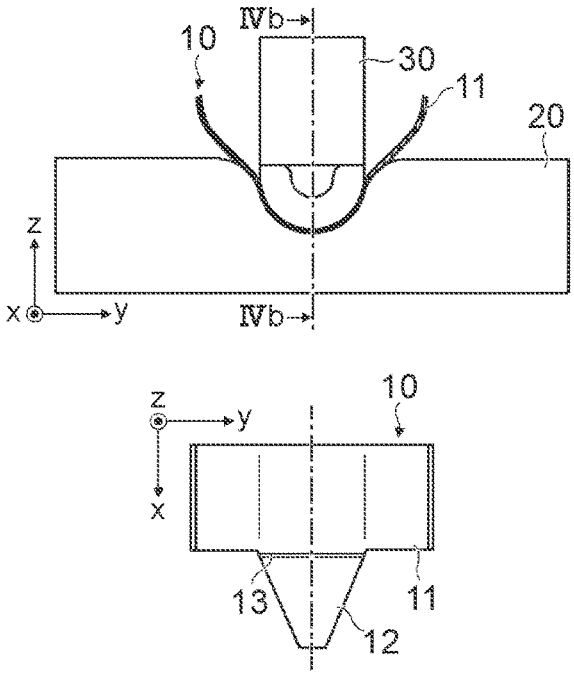
FIG. 3B shows sectional and plan views of the plate member after bending.
Figure 4A:
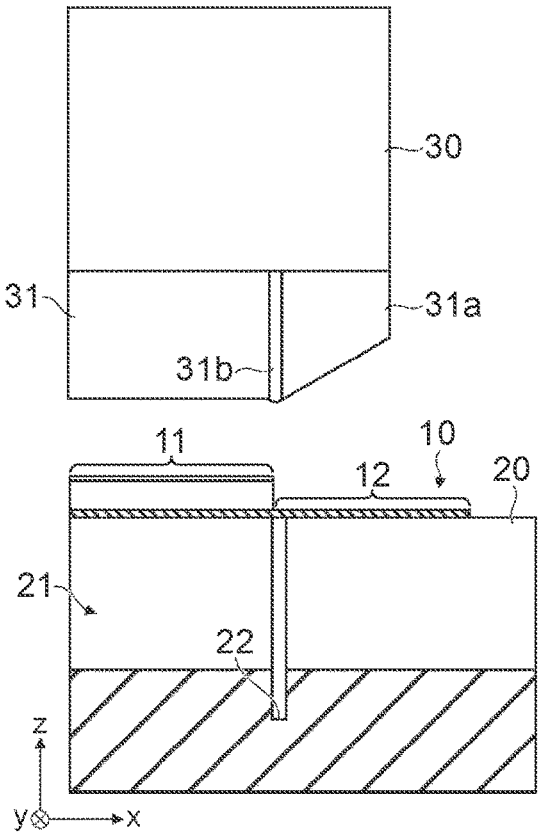
FIG. 4A is a sectional view taken along line IVa-IVa in FIG. 3A.

Next, a tapered part bending process will be described with reference to FIGS. 3A, 3B, 4A, and 4B. FIGS. 3A and 3B illustrate the tapered part bending process. FIG. 3A shows sectional and plan views of the plate member 10 before bending, and FIG. 3B shows sectional and plan views of the plate member 10 after bending. FIG. 4A is a sectional view taken along line IVa-IVa in FIG. 3A, and FIG. 4B is a sectional view taken along line IVb-IVb in FIG. 3B.

As shown in the sectional view of FIG. 3A, in the tapered part bending process, the plate member 10 with the bent ends is placed on a die 20. The plan view of the plate member 10 shown in FIG. 3A is the same as the plan view of the plate member 10 shown in FIG. 2B. As shown in the sectional view of FIG. 3A, the die 20 has a generally semicylindrical cavity 21 in its upper surface. The cavity 21 is formed in the middle part in the longitudinal direction (y-axis direction) of the upper surface of the die 20 and extends in the lateral direction (x-axis direction) of the die 20. A punch 30 is disposed above the die 20. The punch 30 has a generally semicylindrical protruding portion 31 that fits in the cavity 21. In FIGS. 3A and 3B, the die 20 and the punch 30 are not shown in sectional view but in front view.

As shown in FIG. 3B, in the tapered part bending process, the middle part in the longitudinal direction (y-axis direction) of the pipe body portion 11 is sandwiched between the protruding portion 31 of the lowered punch 30 and the cavity 21 of the die 20 and is thus press-formed. Only the middle part in the longitudinal direction (y-axis direction) of the pipe body portion 11 is thus bent into a generally semicircular shape (i.e., U shape). At the same time, as shown in the plan view of FIG. 3B, a bend 13 having a groove shape is formed at the boundary between the pipe body portion 11 and the taper portion 12.

Figure 4B:
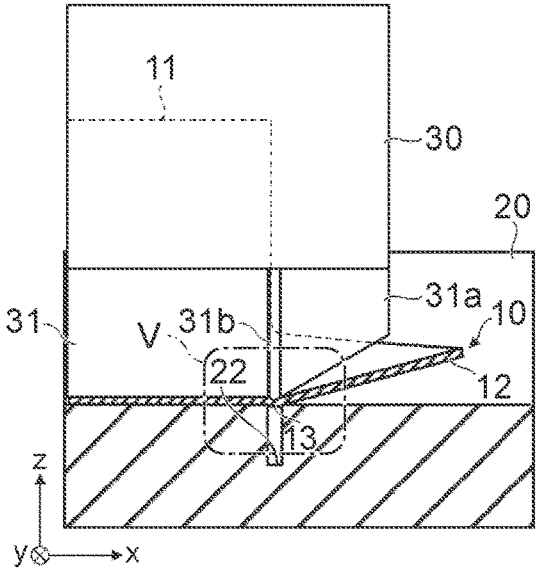
FIG. 4B is a sectional view taken along line IVb-IVb in FIG. 3B.

As shown in FIGS. 4A and 4B, the punch 30 has a ridge 31*b* for forming the bend 13 having a groove shape at the boundary between the pipe body portion 11 and the taper portion 12. The ridge 31*b* is formed on the surface of an end in the longitudinal direction (positive x-axis direction) of the protruding portion 31. More specifically, the ridge 31*b* has a generally semicircular shape (i.e., U shape) extending in the circumferential direction of the generally semicylindrical protruding portion 31. The die 20 has a groove 22 in the surface of the cavity 21. The groove 22 is formed at a position corresponding to the ridge 31*b* of the punch 30. In FIGS. 4A and 4B, the punch 30 is not shown in sectional view but in side view.

As shown in FIGS. 4A and 4B, the punch 30 further has a non-press portion 31*a* on the opposite side of the ridge 31*b* from the protruding portion 31, namely at a position corresponding to the taper portion 12. As shown in FIGS. 3A, 3B, 4A, and 4B, the non-press portion 31*a* is in the shape of a half truncated cone whose diameter decreases as it gets farther away from the ridge 31*b* so that the non-press portion 31*a* does not press the taper portion 12.

As described above, in the tapered part bending process according to the embodiment, the taper portion 12 is bent toward a surface of the plate member 10 corresponding to the inner peripheral surface of the pipe 100 while forming the bend 13 at the boundary between the pipe body portion 11 and the taper portion 12. The taper portion 12 is not directly press-formed. That is, as shown in FIG. 4B, the taper portion 12 is not sandwiched between the die 20 and the punch 30 during press forming. As shown in FIG. 3B, however, since the middle part in the longitudinal direction (y-axis direction) of the pipe body portion 11 is bent into a U shape, the taper portion 12 is also bent accordingly.

Figure 5:
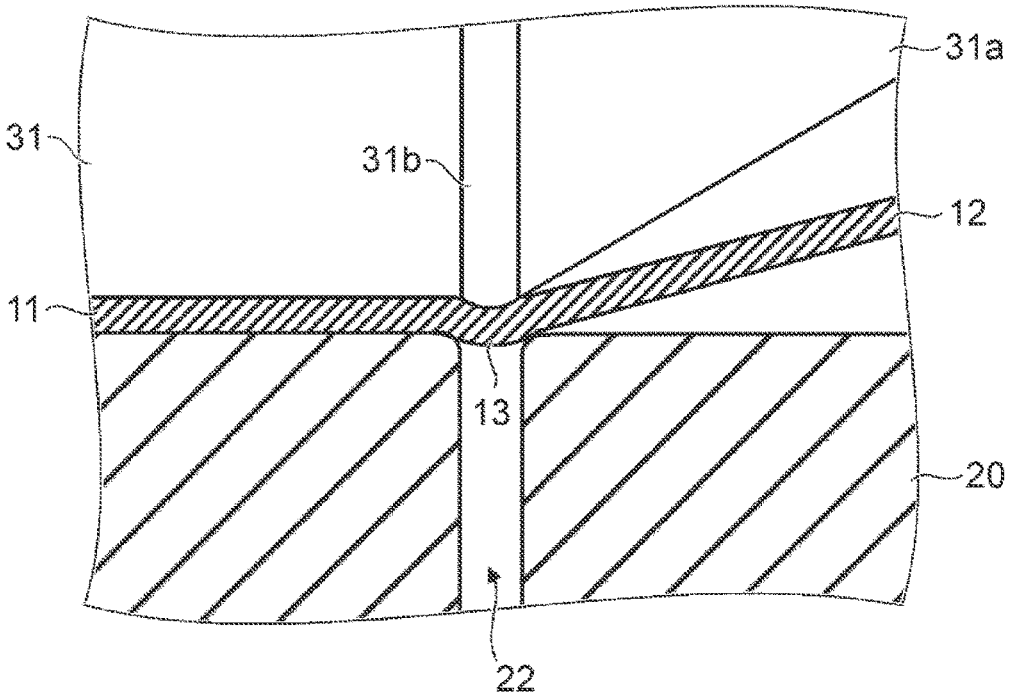
FIG. 5 is an enlarged view of a region V in FIG. 4B.

FIG. 5 is an enlarged view of a region V in FIG. 4B. As shown in FIG. 5, in the method for manufacturing a pipe according to the embodiment, the boundary between the pipe body portion 11 and the taper portion 12 is pressed from the inner surface of the plate member 10 that is the surface of the plate member 10 corresponding to an inner peripheral surface of the pipe 100, before UO forming to bend the taper portion 12 toward the surface of the plate member 10 corresponding to the inner peripheral surface of the pipe 100. This reduces wrinkling and cracking at the boundary between the pipe body portion 11 and the taper portion 12 as compared to the case where the taper portion 12 is bent after U forming or O forming.

In the method for manufacturing a pipe according to the embodiment, not only the taper portion 12 is bent toward the surface of the plate member 10 corresponding to the inner peripheral surface of the pipe 100, but also the ridge 31*b* is pressed against the boundary between the pipe body portion 11 and the taper portion 12 to form the bend 13 having a groove shape. Since the portion where the bend 13 has been formed is work-hardened by compression, the taper angle of the taper portion 12 is maintained even during U forming and O forming that will be performed later. Form accuracy such as the taper angle and the bending radius near the boundary due to springback is less likely to become unstable. Moreover, the tapered part 120 is less likely to be thermally deformed, namely the taper angle of the tapered part 120 is less likely to change due to heat, when the manufactured pipe 100 is exposed to heat.

As shown in FIG. 5, the ridge 31*b* has, e.g., a curved section. The bend 13 has, e.g., a curved section that conforms to the shape of the ridge 31*b*. Accordingly, the plate member 10 is less likely to become excessively thin at the bend 13 and the life of the ridge 31*b* is increased, as compared to the case where the ridge 31*b* has a pointed tip. Since the die 20 has the groove 22, the plate member 10 is also less likely to become excessively thin at the bend 13 and the life of the ridge 31*b* is increased. The taper angle of the taper portion 12 can be adjusted by adjusting, e.g., the height of the ridge 31*b*, the radial dimension of the ridge 31*b*, the width of the groove 22, etc.

Figure 6A:
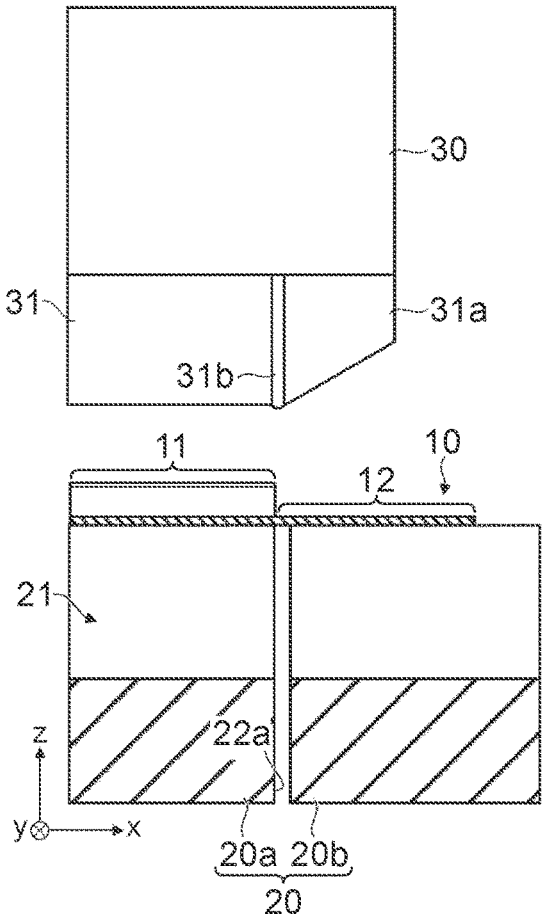
FIG. 6A illustrates a modification of a tapered part bending process.
Figure 6B:
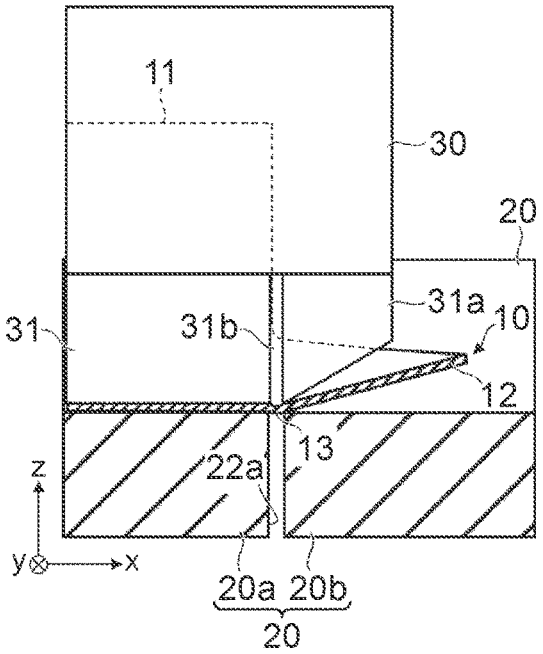
FIG. 6B illustrates a modification of a tapered part bending process.

FIGS. 6A and 6B illustrate a modification of the tapered part bending process. FIGS. 6A and 6B correspond to FIGS. 4A and 4B, respectively. As shown in FIGS. 6A and 6B, instead of the die 20 having the groove 22, the die 20 may be divided into two dies 20*a*, 20*b*, and there may be a clearance 22*a* corresponding to the groove 22 between the dies 20*a*, 20*b*. This configuration has effects similar to those in the case where the die 20 has the groove 22. The edge bending process shown in FIGS. 2A and 2B may be performed simultaneously with the tapered part bending process.

Figure 7A:
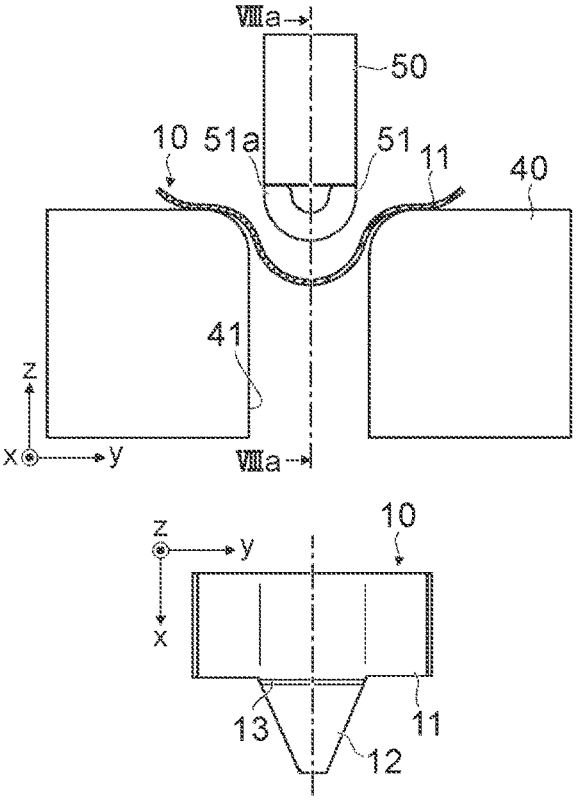
FIG. 7A shows sectional and plan views of the plate member before U forming.
Figure 7B:
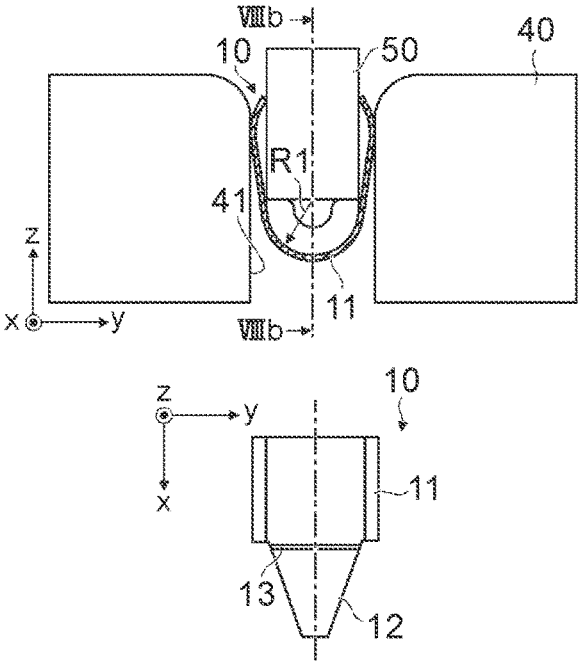
FIG. 7B shows sectional and plan views of the plate member after U forming.
Figure 8A:
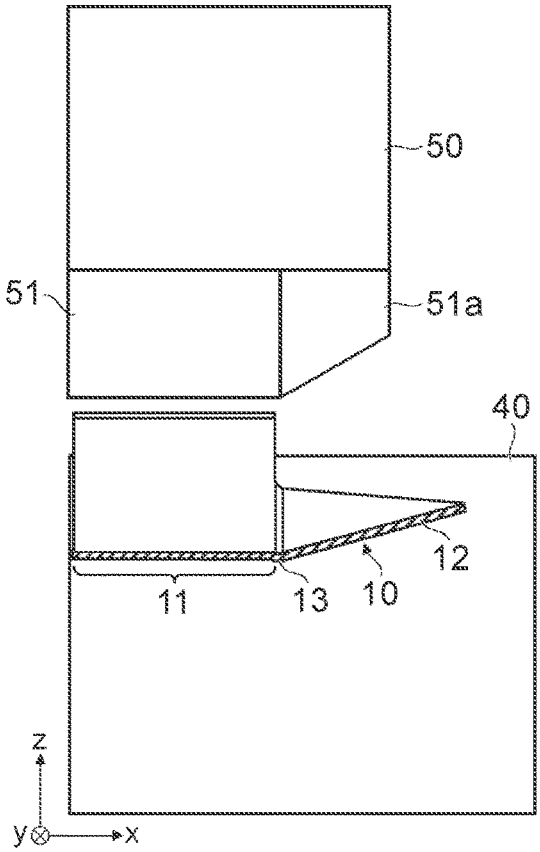
FIG. 8A is a sectional view taken along line VIIIa-VIIIa in FIG. 7A.
Figure 8B:
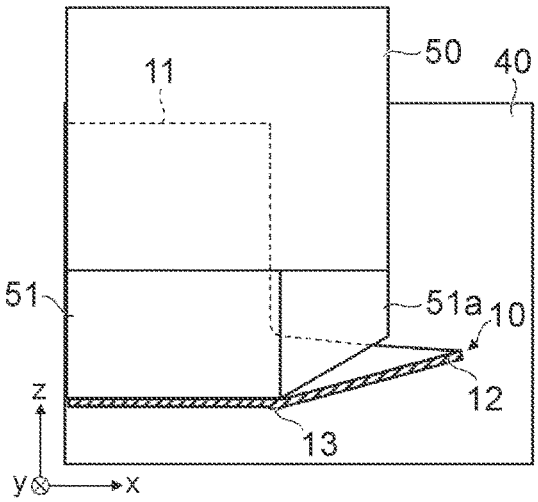
FIG. 8B is a sectional view taken along line VIIIb-VIIIb in FIG. 7B.

Next, a U forming process will be described with reference to FIGS. 7A, 7B, 8A, and 8B. FIGS. 7A and 7B illustrate the U forming process. FIG. 7A shows sectional and plan views of the plate member 10 before U forming, and FIG. 7B shows sectional and plan views of the plate member 10 after U forming. FIG. 8A is a sectional view taken along line VIIIa-VIIIa in FIG. 7A, and FIG. 8B is a sectional view taken along line VIIIb-VIIIb in FIG. 7B.

As shown in the sectional view of FIG. 7A, in the U forming process, the plate member 10 is placed on a U forming die 40 with the middle part in the longitudinal direction (y-axis direction) of the pipe body portion 11 being bent into a generally semicircular shape. The plan view of the plate member 10 shown in FIG. 7A is the same as the plan view of the plate member 10 shown in FIG. 3B.

As shown in the sectional view of FIG. 7A, the U forming die 40 is composed of a pair of blocks disposed facing each other with a U forming clearance 41 therebetween. As shown in FIGS. 7A and 7B, the clearance 41 extends in the lateral direction (x-axis direction). A U forming punch 50 to be inserted into the clearance 41 is disposed above the U forming die 40. Like the punch 30 shown in FIGS. 3A and 3B, the U forming punch 50 has a generally semicylindrical protruding portion 51 at its lower end. In FIGS. 7A and 7B, the U forming die 40 and the U forming punch 50 are not shown in sectional view but in front view.

As shown in FIG. 7B, in the U forming process, the entire pipe body portion 11 is inserted into the clearance 41 of the U forming die 40 while pressing the middle part in the longitudinal direction (y-axis direction) of the pipe body portion 11 with the protruding portion 51 of the lowered U forming punch 50. The entire pipe body portion 11 is thus bent into a U shape. Specifically, both sides of the pipe body portion 11 are bent upward (in the positive z-axis direction) using the middle part in the longitudinal direction of the pipe body portion 11 as a fulcrum. It is preferable that the radius of curvature R1 of the pipe body portion 11 formed by the protruding portion 51 of the U forming punch 50 be smaller than, e.g., the radius of the pipe 100 to be manufactured.

As shown in FIGS. 8A and 8B, like the punch 30 shown in FIGS. 4A and 4B, the U forming punch 50 has a non-press portion 51*a* at a position corresponding to the taper portion 12. As shown in FIGS. 7A, 7B, 8A, and 8B, the non-press portion 51*a* is in the shape of a half truncated cone whose diameter decreases as it gets farther away from the protruding portion 51 so that the non-press portion 51*a* does not press the taper portion 12.

As described above, in the U forming process according to the embodiment, the taper portion 12 is not directly press-formed. That is, as shown in FIG. 8B, the taper portion 12 is not pressed by the U forming punch 50 during press forming. As shown in FIG. 7B, however, since the pipe body portion 11 is bent with the radius of curvature R1, the taper portion 12 is also bent accordingly. In FIGS. 8A and 8B, the U forming punch 50 is not shown in sectional view but in side view.

Figure 9A:
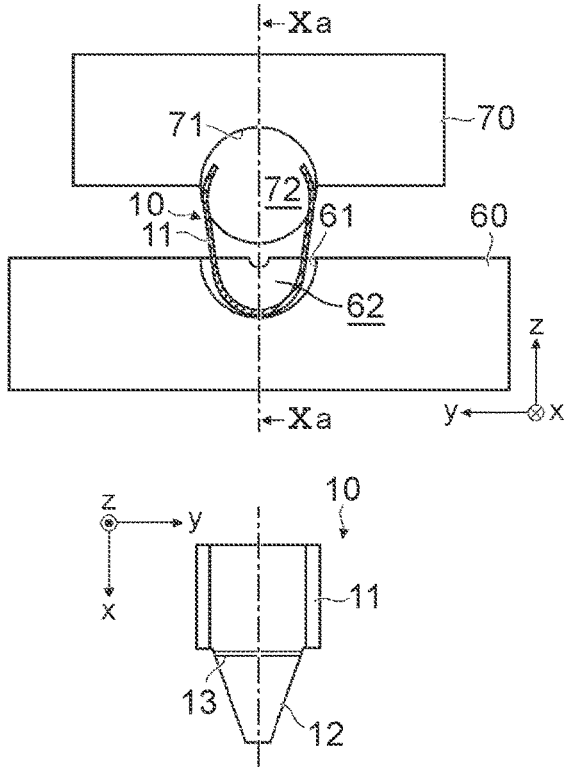
FIG. 9A shows sectional and plan views of the plate member before O forming.
Figure 9B:
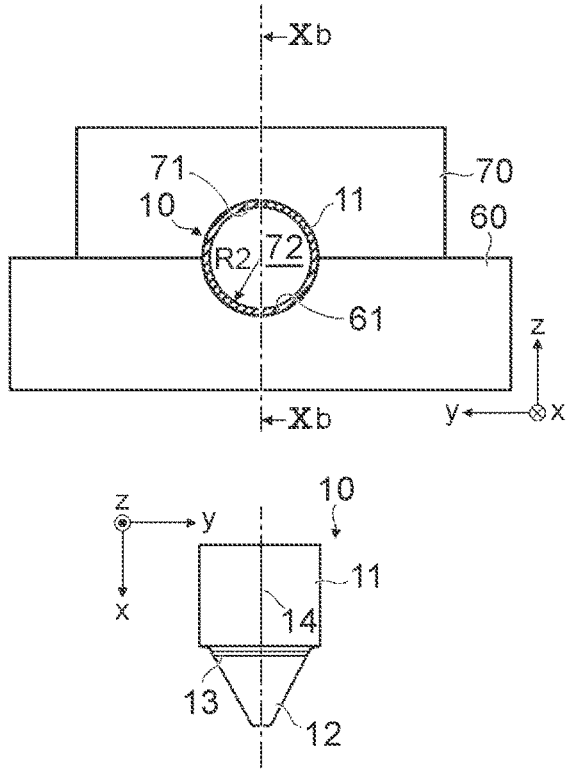
FIG. 9B shows sectional and plan views of the plate member after O forming.
Figure 10A:
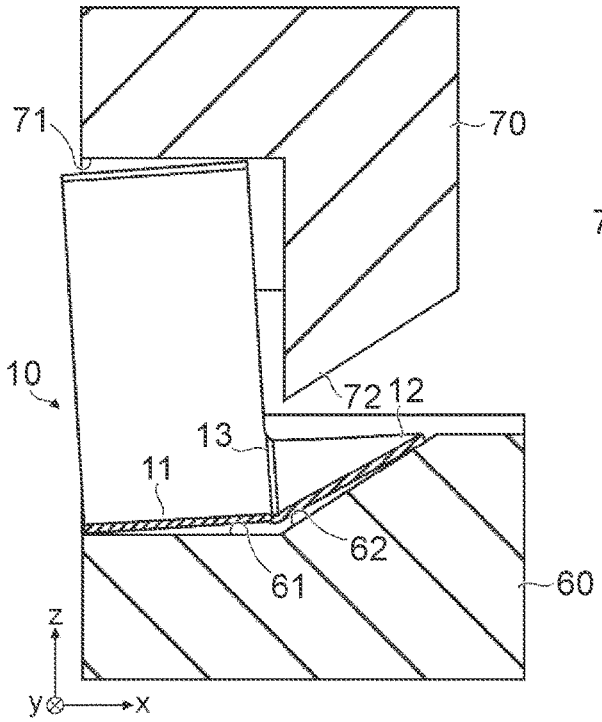
FIG. 10A is a sectional view taken along line Xa-Xa in FIG. 9A.

Next, an O forming process will be described with reference to FIGS. 9A, 9B, 10A, and 10B. FIGS. 9A and 9B illustrate the O forming process. FIG. 9A shows sectional and plan views of the plate member 10 before O forming, and FIG. 9B shows sectional and plan views of the plate member 10 after O forming. FIG. 10A is a sectional view taken along line Xa-Xa in FIG. 9A, and FIG. 10B is a sectional view taken along line Xb-Xb in FIG. 9B.

As shown in the sectional view of FIG. 9A, in the O forming process, the plate member 10 with the entire pipe body portion 11 bent into a U shape is placed on an O forming lower die 60. The plan view of the plate member 10 shown in FIG. 9A is the same as the plan view of the plate member 10 shown in FIG. 7B.

As shown in the sectional view of FIG. 9A and in FIG. 10A, the O forming lower die 60 has a semicylindrical O forming cavity 61 in its upper surface. The cavity 61 is formed in the middle part in the longitudinal direction (y-axis direction) of the upper surface of the O forming lower die 60 and extends in the lateral direction (x-axis direction) of the O forming lower die 60. An O forming upper die 70 is disposed above the O forming lower die 60. Like the O forming lower die 60, the O forming upper die 70 also has a semicylindrical O forming cavity 71 in its lower surface. The cavity 71 is formed in the middle part in the longitudinal direction (y-axis direction) of the lower surface of the O forming upper die 70 and extends in the lateral direction (x-axis direction) of the O forming upper die 70. In FIGS. 9A and 9B, the O forming lower die 60 and the O forming upper die 70 are not shown in sectional view but in rear view.

Figure 10B:
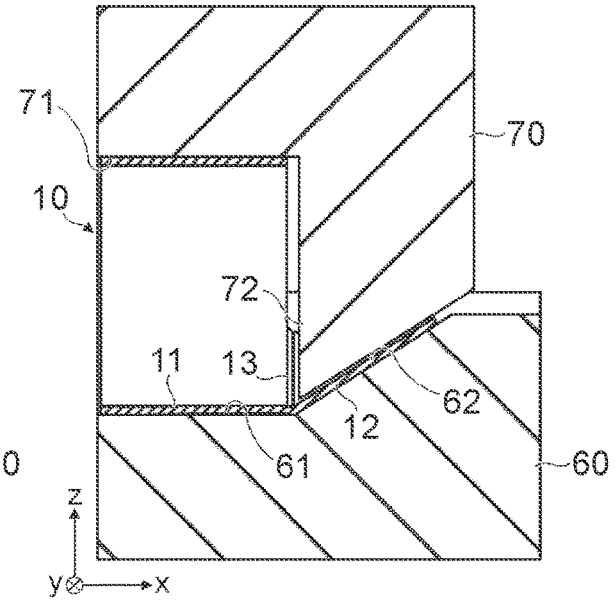
FIG. 10B is a sectional view taken along line Xb-Xb in FIG. 9B.

As shown in FIGS. 9B and 10B, the O forming lower die 60 and the O forming upper die 70 are caused to abut on each other. The cavity 61 and the cavity 71 thus form a cylindrical O forming cavity. In the O forming process, the lower side of the pipe body portion 11 bent into a U shape is pressed against the cavity 61 of the O forming lower die 60, and the upper side of the pipe body portion 11 is pressed against the cavity 71 of the O forming upper die 70. The entire pipe body portion 11 is thus bent into an O shape, and the pipe body portion 11 is formed into a pipe.

As shown in FIG. 9B, the radius of curvature R2 of the pipe body portion 11 formed by the cavity 61 of the O forming lower die 60 is equal to the radius of the pipe 100 to be manufactured. As described above, when the radius of curvature R1 of the pipe body portion 11 formed by the protruding portion 51 of the U forming punch 50 shown in FIGS. 7A and 7B is smaller than the radius of curvature R2, abutting surfaces 14 of the pipe body portion 11 are pressed against each other after O forming. Accordingly, a gap between the abutting surfaces 14 can be reduced. As described above, for example, the abutting surfaces 14 are welded together. The abutting surfaces 14 may be corrugated within a weld bead width in order to increase the joint length between the abutting surfaces 14.

As shown in FIGS. 9A, 9B, 10A, and 10B, the O forming lower die 60 has a semiconical taper forming cavity 62 at a position corresponding to the taper portion 12. The O forming upper die 70 has a semiconical taper forming protruding portion 72 that fits in the taper forming cavity 62 of the O forming lower die 60. In the O forming process according to the embodiment, the taper portion 12 is press-formed so as to have a desired taper angle.

As in the U forming process shown in FIGS. 7A, 7B, 8A, and 8B, the taper portion 12 may not be directly press-formed in the O forming process. In the U forming process, as in the O forming process shown in FIGS. 9A, 9B, 10A, and 10B, the taper portion 12 may be press-formed so as to have a desired taper angle.

As described above, in the method for manufacturing a pipe according to the embodiment, the boundary between the pipe body portion 11 and the taper portion 12 is pressed from the inner surface of the plate member 10 that is a surface of the plate member 10 corresponding to an inner peripheral surface of the pipe 100, before UO forming to bend the taper portion 12 toward the surface of the plate member 10 corresponding to the inner peripheral surface of the pipe 100. This reduces wrinkling and cracking at the boundary between the pipe body portion 11 and the taper portion 12 as compared to the case where the taper portion 12 is bent after U forming or O forming.

In the method for manufacturing a pipe according to the embodiment, not only the taper portion 12 is bent toward the surface of the plate member 10 corresponding to the inner peripheral surface of the pipe 100, but also the ridge 31*b* is pressed against the boundary between the pipe body portion 11 and the taper portion 12 to form the bend 13 having a groove shape. Since the portion where the bend 13 has been formed is work-hardened by compression, the taper angle of the taper portion 12 is maintained even during U forming and O forming that will be performed later, and springback is also reduced. Moreover, the tapered part 120 is less likely to be thermally deformed, namely the taper angle of the tapered part 120 is less likely to change due to heat, when the manufactured pipe 100 is exposed to heat.

The disclosure is not limited to the above embodiment and can be modified without departing from the spirit and scope of the disclosure.

What is claimed is:

1. A method for manufacturing a pipe having a pipe body and a tapered part tilted radially inward and protruding from one end of the pipe body, the method comprising:

press-forming a plate member into a U shape;

press-forming a groove into a boundary between a portion of the plate member corresponding to the pipe body and a portion of the plate member corresponding to the tapered part at a surface of the plate member corresponding to an inner peripheral surface of the pipe to bend a portion of the plate member corresponding to the tapered part toward the surface of the plate member corresponding to the inner peripheral surface of the pipe; and press-forming the plate member formed into the U shape into an O shape.

2. The method according to claim 1, wherein the groove has a curved section.

3. The method according to claim 1, wherein when the boundary is pressed, the groove is formed while bending a middle part of the portion corresponding to the pipe body into a U shape.

4. The method according to claim 1, wherein the groove is formed by pressing the boundary with a punch having a ridge corresponding to the groove.

5. The method according to claim 4, wherein a die on which the plate member is placed when the boundary is pressed is provided with a die groove at a position corresponding to the ridge of the punch.

6. The method according to claim 4, wherein:

a die on which the plate member is placed when the boundary is pressed is a die divided by a clearance that is predetermined; and the clearance is located at a position corresponding to the ridge of the punch.

7. The method according to claim 4, wherein the ridge of the punch has a curved section.

8. The method according to claim 1, wherein a radius of curvature of the portion corresponding to the pipe body after the plate member is press-formed into the U shape is smaller than a radius of curvature of the portion corresponding to the pipe body after the plate member formed into the U shape is press-formed into the O shape.

* * * * *